United States Patent [19]

Strickland

[11] 4,333,289

[45] Jun. 8, 1982

[54] CONCRETE FORM SUPPORT STRUCTURE

[75] Inventor: James K. Strickland, Jacksonville, Fla.

[73] Assignee: Strickland Systems, Inc., Jacksonville, Fla.

[21] Appl. No.: 125,939

[22] Filed: Feb. 29, 1980

[51] Int. Cl.[3] ..... B24B 45/00

[52] U.S. Cl. ..... 52/364; 52/376; 52/729; 52/730; 249/18

[58] Field of Search ..... 52/376, 377, 364, 368, 52/729, 710, 372-375, 463-466, 730; 249/18

[56] References Cited

U.S. PATENT DOCUMENTS

| | | | |
|---|---|---|---|
| 1,008,343 | 11/1911 | King . | |
| 1,893,480 | 1/1933 | Mitchell | 52/710 |
| 3,199,258 | 8/1965 | Tentoft | 52/468 |
| 3,457,698 | 7/1969 | Albers | 52/468 |
| 3,665,666 | 5/1972 | Delcroix | 52/468 |
| 3,787,020 | 1/1974 | Avery | 52/376 |
| 3,899,152 | 8/1975 | Avery | 249/18 |
| 4,033,544 | 7/1977 | Johnston | 52/738 |
| 4,034,957 | 7/1977 | Cody | 52/729 |
| 4,077,172 | 3/1978 | Johnston | 52/376 |
| 4,106,256 | 8/1978 | Cody | 52/646 |
| 4,133,155 | 1/1979 | Oelrich | 52/372 |
| 4,144,690 | 3/1979 | Avery | 52/376 |
| 4,156,999 | 6/1979 | Avery | 52/376 |

*Primary Examiner*—Price C. Faw, Jr.
*Assistant Examiner*—Henry E. Raduazo
*Attorney, Agent, or Firm*—Schuyler, Banner, Birch, McKie and Beckett

[57] ABSTRACT

In the support of a concrete form panel, an elongate beam, acting as a waler, is employed that is in the general cross-sectional shape of an I-beam having an outwardly opening pocket extending along one edge to retain a nailer for securing the beam to the form panel and a Y-shaped segment extending along the opposite beam edge. The Y-shaped segment is formed by legs which are parallel for one length thereof to define an outwardly opening cavity there between and then the legs diverge outwardly for a second length with oppositely directed flanges extending from the outer ends of the diverging second length of the legs. A bracket having a flat portion inserted into the beam cavity is secured in the cavity and has a tubular portion connected to the flat portion, the tubular portion accommodating a fastening element therewithin to fasten the bracket to a stiffener member, preferrably provided by spaced outwardly facing channels with the bracket tubular portion disposed between the channel webs.

2 Claims, 5 Drawing Figures

CONCRETE FORM SUPPORT STRUCTURE

BACKGROUND OF THE INVENTION

The herein described invention relates generally to the field of poured concrete building construction and more particularly is directed to concrete form panel support such as employed in assembling concrete forms into functional units either in the field or at a factory location for subsequent transportation to a site where they are to be used. The invention involves apparatus used in concrete form panel support with a specific form of elongate beam having a generally uniform I-shaped cross section, characteristically used as a waler, and a cooperating bracket which is to be affixed to the beam and utilized in securing the beam to a stiffener member or strongback, the beam and bracket forming parts of a concrete form panel support structure.

In the field of construction where concrete forms are provided by panels maintained in opposed relationship to each other and between which the soft concrete is poured prior art structures often utilize tie rods extending between both the opposed panels with various forms of wedging or locking devices provided to grip the ends of the tie rods and prevent outward movement of the form panels. Frequently, these devices, employed in conjunction with the forms, have utilized spacers on the tie rods to prevent inward movement of the spaced form panels.

Generally, the above mentioned tie rods and locking devices are associated with stiffeners disposed on opposite sides of the spaced form panels that are generally referred to as strongbacks. In a concrete wall construction each strongback frequently consists of back to back spaced steel channels. The form panel itself is often constructed from sheets of plywood and spaced walers or elongated beams are in turn secured to the back of the panel in strengthening the panel's plywood sheets against distortion when the concrete is poured between the opposed panels. The elongate beams or walers are in turn suitable fastened to the above mentioned stiffeners or strongbacks in completing the form panel support structure.

Of course the plurality of spaced walers secured along the back surface of each form panel add substantially to the weight of the overall form panel support structure. Characteristically, the walers have been provided by wooden members to which the plywood sheet panel, forming the concrete casting form, has been fastened. More recently, proposals using extruded aluminum walers have been suggested to reduce the weight requirements for the overall structure while retaining the necessary strength. These aluminum walers are provided with wooden nailers to which the plywood sheet panel is affixed by screws, nails or other means. Then, outward of the walers, the stiffeners or strongbacks must be affixed to the walers to assure the requisite strength for the concrete form panel incident pouring of the concrete.

It is indeed desireable in the concrete form panel structure that maximum flexibility in the utilization of lightweight aluminum walers be permitted, both in affixation of the walers to the plywood sheet panel, as by a nailer retained a pocket on the aluminum waler, and also in the accommodating maximum freedom in location of the stiffeners or strongbacks relative to the walers as may be needed to meet specific installation requirements for the concrete wall or other structure being made.

In prior proposals utilizing lightweight walers providing maximum flexibility and freedom in connecting the walers to spaced strongbacks has been a problem. Further, many prior art proposals do not provide the desired positive and rigid connection of the walers to the steel channel strongbacks as is necessary in achieving full and maximum strength for the concrete form panel structure.

Considering the disadvantages of the prior art proposals, a principal object of the present invention is to provide the concrete form support structure with apparatus where maximum weight reduction in the overall form panel support structure is provided.

Likewise, an important object is to permit flexibility and freedom in securing the panel reinforcing beams or walers to the form panel and to the stiffeners or strongbacks.

It is another object of this invention to provide a concrete form panel supporting apparatus wherein an elongate panel reinforcing beam is connected by a bracket which performs the dual purpose of spacing the beam or waler properly with reference to the stiffeners or strongbacks and also acts to appropriately space the elements making up the strongback so that the strongback elements can properly accommodate therebetween the tie rods that serve to hold one concrete form panel relative to the opposed concrete form panel between which panels the concrete is poured.

A further object of the invention is in the provision of a panel reinforcing apparatus which enables versatility in utilization with existing components that are provided for concrete form panel support structures.

An additional object is to provide for universal application of the walers, brackets and strongbacks into currently available concrete panel supporting structures.

SUMMARY OF THE INVENTION

Briefly stated, the invention is directed to apparatus for use in concrete form panel support. The invention contemplates the use of elongate beams having a generaly uniform I-shaped cross section. Each beam has an outwardly opening pocket extending along one edge thereof to retain a nailer for securing this beam to a form panel such as made up of sheets of plywood. The opposite edge of each beam has a Y-shaped segment extending therealong. This segment is formed by legs which have a first length thereof parallel to each other to define therebetween an outwardly opening cavity and beyond this a second length of the legs which diverge outwardly from the first length forming the cavity. Then at the outer ends of the legs there are outwardly and oppositely directed flanges. The flanges are provided to engage with a stiffener member, generally known as a strongback, that forms a part of the panel support structure.

Further, the invention contemplates utilizing a bracket which has a flat portion that is insertable into the cavity of the elongate beam or waler. The bracket has a tubular portion that is connected to the flat portion and is designed to accommodate a fastening element therewithin which acts to fasten the bracket to a stiffener member or strongback. The bracket then is appropriately fastened or secured by the flat portion in the cavity of the Y-shaped segment of the elongate beam at a predetermined position along the length of the beam.

The flat portion of the bracket fitting snugly into the cavity and secured therein assures positive and strong connection of the bracket to the elongate beam or waler. Likewise there are advantages in that the tubular portion of the bracket positively holds the fastening element that connects the bracket to the stiffener member and in that the length of this tubular portion acts between the spaced channels making up the stiffener member or strongback to maintain the desired and necessary spacing between these channels so that the connecting tie rods for the concrete form panels can pass between the channels and serve to keep the form panel support structure in proper assembled condition.

BRIEF DESCRIPTION OF THE DRAWINGS

The foregoing objects, as well as the other advantages of the invention will become apparent by reference to the following detailed description of the invention taken in connection with the accompanying drawings in which.

DETAILED DESCRIPTION OF ILLUSTRATIVE EMBODIMENTS

Figure 1:
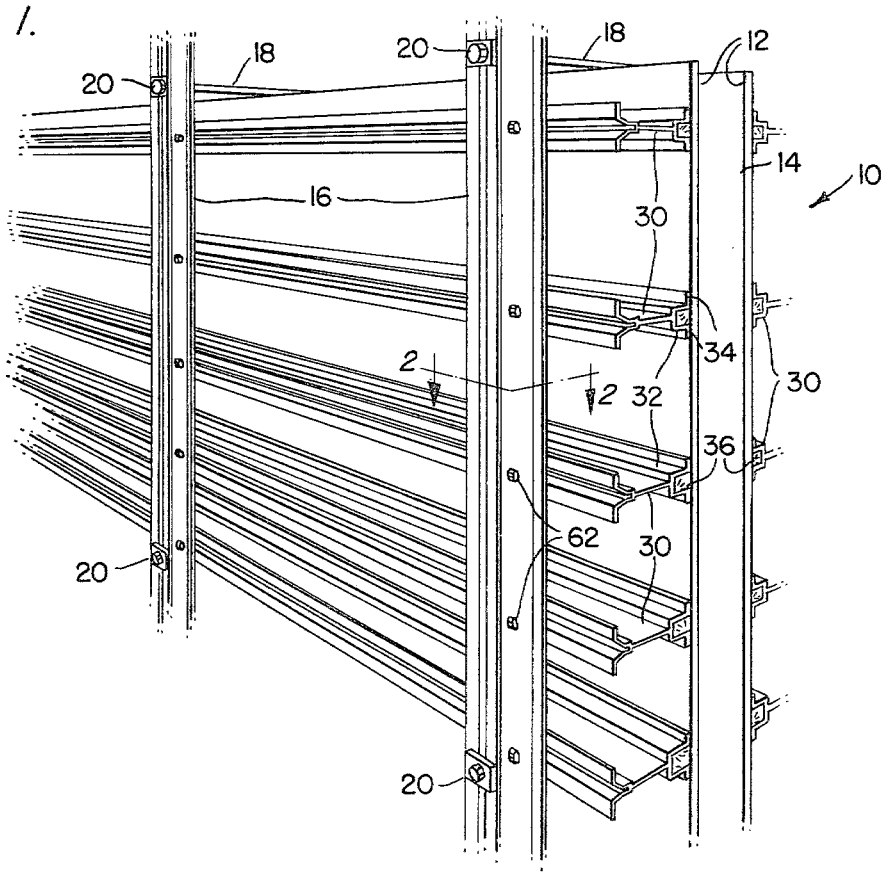
FIG. 1 is a perspective view of a typical installation utilizing the invention.

Reference should initially be made to FIG. 1, on the drawings which illustrates embodiment of the invention in a complete concrete form panel support structure, thus showing the overall environment for utilization of the invention. Solely for purposes of illustration the invention is shown in FIG. 1 embodied in a wall concrete form panel structure. However, it is to be recognized that the apparatus of this invention may just as well be incorporated in a form panel support structure that is employed to create a floor or other poured concrete configuration.

In FIG. 1 the form panels support structure 10 is constructed by a pair of spaced opposed panels 12 defining between the faces thereof a space 14 into which the soft concrete is to be poured in forming a wall. The panels 12 may be suitably provided by sheets of plywood such that the plywood sheets form the opposite faces of the concrete wall as cast. When the concrete has set up after being poured the panels 12 are, of course, stripped from the set up wall for reuse at a new desired location.

Vertical spaced stiffeners or strongbacks 16 are provided outwardly of each panel 12, a pair of stiffeners 16 being shown on only one side of the structure on FIG. 1. These provide major strengthening for the panel support structure. Although only two stiffeners 16 are shown in FIG. 1, it will be understood that similar stiffeners (not shown) will be provided on the opposite side of the wall form and outward of the opposite panel 12. The stiffeners or strongbacks 16 are spaced along the wall form panels 12 at predetermined distances. The stiffeners 16 on opposite sides of the wall form panels 12 are secured together by tie rods 18 which, as known in the art, are provided with suitable fastening means 20 at their outer ends to cooperate with each stiffener 16 in maintaining the stiffeners in proper position for support of the wall form panels 12.

The securing means 20 may take any one of a variety of forms for cooperation with the stiffeners 16. Merely by way of example, a suitable tying device to function as a tie rod 18 and securing means 20 is illustrated in U.S. Pat. No. 4,044,986 issued Aug. 30, 1977.

In the wall form embodiment shown for purposes of illustration, the plywood form panels 12 are reinforced by elongate beams or walers 30. These walers or beams are spaced and extend horizontally along the outer side of each panel 12. The panels are then secured, by means described hereinbelow, to the stiffeners or walers 16. Although not shown fully in FIG. 1, it is to be understood that elongate beams or walers 30 are also provided on the outside of the opposed panel 12.

Figure 3:
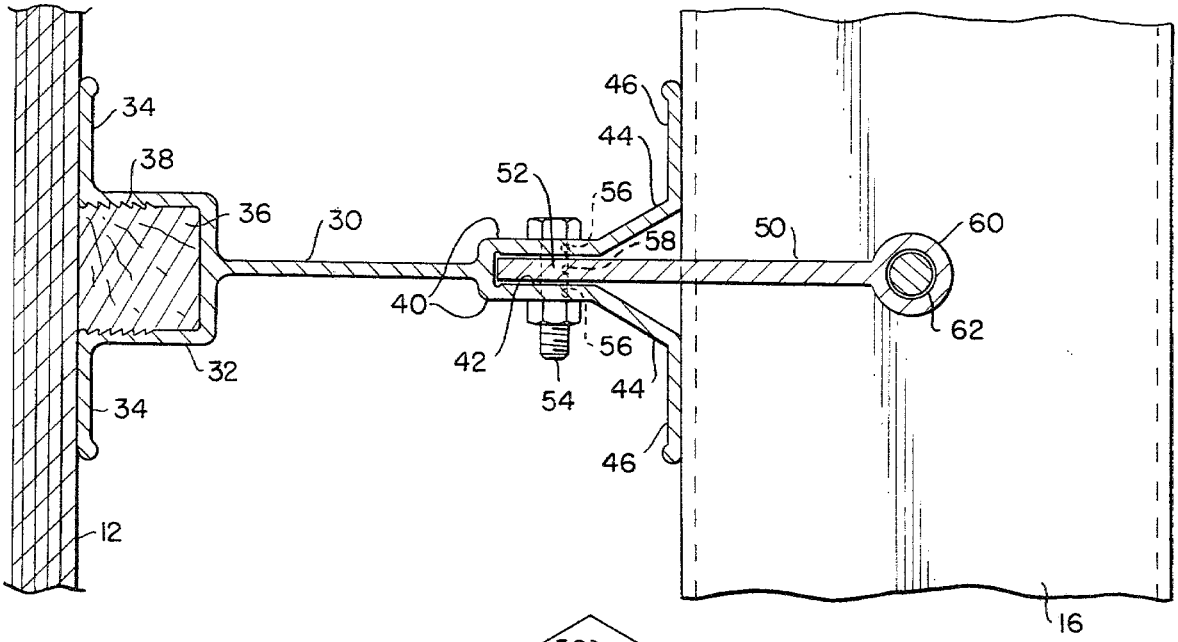
FIG. 3 is a sectional view taken on line 3—3 of FIG. 2.

As best shown in the sectional view of FIG. 3, each elongate beam or waler 30 has a generally uniform I-shaped cross section. The web of the I-section has formed along one edge thereof an outwardly opening pocket 32 with flanges 34 extending outwardly from the outer edges of the pocket 32. Each pocket 32 retains therein a wooden nailer 36. The inwardly facing walls of pocket 32 are provided with longitudinally extending teeth 38. The wooden nailer 36 is forcibly inserted into pocket 32 so that the teeth 38 grippingly retain wooden nailer 36 in the pocket. The wooden nailer 36 thus enables the plywood form panel 12 to be nailed, screwed or otherwise fastened to the nailer 36, thereby retaining elongate beam or waler 30 on the outer side of the plywood form panel 12.

The opposite edge of the beam or waler has extending there along a Y-shaped segment which is formed by legs that have one length 40 thereof parallel to each other to define there between an outwardly opening cavity 42. A second length 44 of the legs forming the Y-shaped segment diverges outwardly from the parallel length 40 of these legs, again as shown in FIG. 3. The outer ends of the second length 44 of the legs are provided with oppositely directed flanges 46 extending outwardly from the outer end of the diverging second length 44 of the legs. From the drawings, it will be clearly seen that the portions of the legs forming flanges 46 engage against the side of the stiffeners or strongbacks 16 and are affixed thereto by brackets 50, as described in detail hereinafter.

Each bracket 50 has a flat portion 52 that is snugly received within the cavity 42 of the beam or waler 30. The flat portion 52 of the bracket 50 is secured in the cavity 42 by a retaining member 54, shown in the form of a threaded fastener provided by a bolt and cooperating nut as shown in FIG. 3. To accommodate the retaining member 54, aligned openings 56 are provided in the opposed walls of the cavity 42, such openings being formed in the length 40 of the legs forming the Y-shaped segment of the beam or waler 30.

It is preferred that at least two retaining members 54 be provided in retaining the flat portion 52 of bracket 50 within the cavity 42 of the beam or waler 30. Thus, in both of the embodiments for the bracket 50 as shown on the drawings, there are provided two pairs of openings 56 and two apertures 58 to accommodate a pair of threaded fasteners 54.

Figure 2:
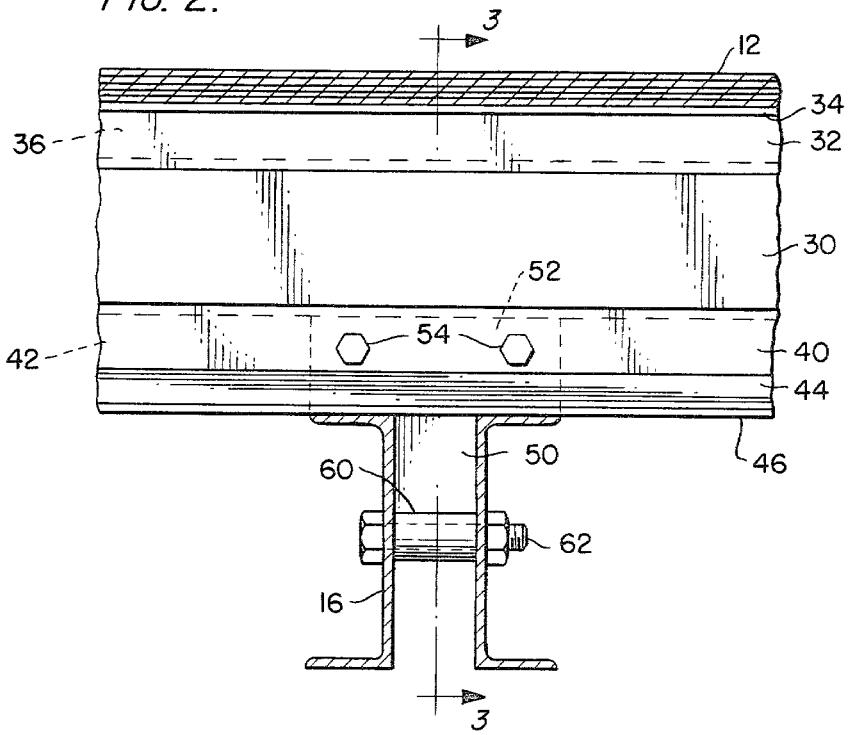
FIG. 2 is a sectional view taken on line 2—2 of FIG. 1.
Figure 4:
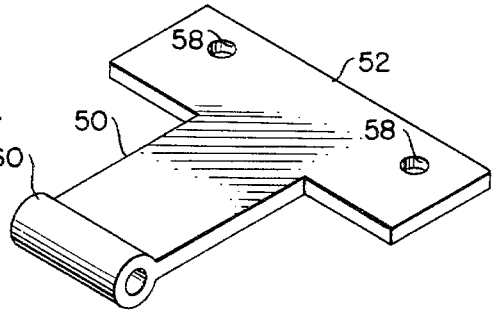
FIG. 4 is a perspective view of one form of bracket to connect an elongate beam and stiffener member.
Figure 5:
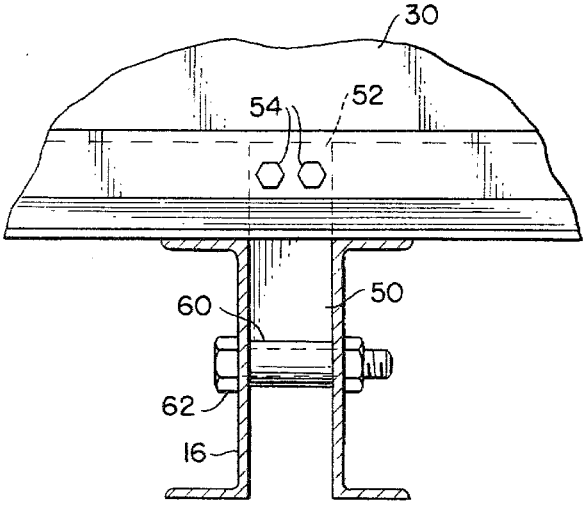
FIG. 5 is a partial sectional view, similar to the sectional of FIG. 2, but utilizing a modified form of the bracket.

Referring to the two embodiments for the bracket 50 it will be noted that, as shown in FIGS. 2 and 4 the flat portion 52 of the bracket 50, to be snugly received in the cavity 42, has a widened flat portion 52 giving the overall planar configuration of a T-shape to the bracket 50. This widened flat portion 52 in the embodiment of FIGS. 2 and 4 gives increased stability for the bracket when mounted in the cavity 42 on the beam or waler 30. In FIG. 5, an alternative embodiment for the bracket 50 has the flat portion 52 formed of a width equal to the overall length of the bracket 50. Still, two threaded fasteners 54 are employed in affixing the bracket 50 within the cavity 42 of the beam or waler 30.

The opposite end of bracket 50, in both embodiments as illustrated, is provided with a tubular portion 60. This tubular portion 60 passes between the back-to-back channels making up the stiffener or strongback 16 and a fastening element 62 is accommodated within the tubular portion 60. This fastening element passes through bores formed in the stiffener or strongback 16 to fixedly secure the bracket 50 to the stiffener 16. Fastening element 62 may be suitable provided by a standard threadably interengaged bolt and nut connector. Significantly, it will be noted that the length of the tubular portion 60 on bracket 50 forms a spacer that determines the spacing between the channels making up the stiffener or strongback 16. Accordingly, when the fastening element 62 is tightened down on the channels making up the stiffener 16, as shown in FIGS. 2 and 5, the proper spacing between the channels of the stiffener or strongback will be limited and determined by the configuration of the bracket 50 and, specifically, by the overall length of tubular portion 60.

The assembly of a concrete form panel support structure utilizing the components of the invention herein will be apparent from the above description of the apparatus. Reference may be made to FIG. 1 and the components identified thereon for an understanding of the assembly of one side of a complete concrete form panel support structure.

A form panel 12, suitably provided by sheets of plywood, will have affixed thereto, in spaced parallel relation, elongate beams or walers 30. Each waler will have a nailer 36 retained in the pocket 32 of the beam 30 to which the panel 12 is nailed or otherwise fastened. Then, in supporting the beams 30 and panel 12, appropriate brackets 50 will be fixed in the cavity 42 of each beam 30. A stiffener or strongback 16, appropriately made up of spaced back-to-back steel channels, will then be mounted with the tubular portion 60 of each bracket 50 extending inwardly between the channels forming the stiffener or strongback 16. Fastening elements 62 will be extended through the tubular portions 60 and also through the channels forming the stiffener or strongback 16. These hold the overall structure in the relationship as shown in FIG. 1 for the pouring of concrete into the space 14 between the spaced panels 12.

Having described the basic features of the invention, reference may now be made to certain important advantages or differences in applicant's invention herein over the prior art. The connecting brackets 50, as will be appreciated, are captive between the channels in the strengthening stiffeners or strongbacks 16. Then, when the flat portions 52 of the brackets 50 are inserted and bolted into the aluminum elongate beams or walers 30, a rigid positive connection between the strongbacks 16 and walers 30 is achieved. The plurality of bolts retaining the flat portions 52 of brackets 50 in the cavities 42 of elongate beams or walers 30 serve to promote the strength of the overall assembled structure. It will be further noted that the connecting brackets 50 serve the dual purpose of not only enabling their effective and strong attachment to the elongate beams 30 but they also function to space the channels desirably used in forming the stiffener or strongback 16. This channel spacing facilitates passage of the tie rods 18 between the channels of the stiffener 16 to hold opposed concrete form panels 12 on opposite sides of the concrete wall to be poured.

Preferably, the elongate beams or walers 30 are formed out of extruded aluminum to have a uniform cross section throughout their length. The height or width of these beams 30 and their other dimensional configurations may be idealy related and adapted to standard U.S. lumber dimensions used in connection with the concrete form panel support structure. It may be noted that the ability for selective insertion of the brackets 50 anywhere and at any point along the Y-shaped segment of the elongate beam 30 constitutes a definite improvement over the requirement for sliding movement of a captive bolt head as is employed in some prior art configurations. The brackets 50 serve the two fold purpose of spacing the beam or walers 30 properly relative to the strongbacks 16. Also, the length of the tubular portion 60 on each bracket 50 properly spaces the steel channels of the stiffener or strongback 16 in such a manner that the form tie rods and other hardware can easily be bolted to the form work. A further benefit is obtained in that all connecting bolts used in the concrete form panel support are stand and off-the-shelf items with no special fasteners being required.

Utilization of the brackets in connecting the aluminum beams 30 to the steel channel strongbacks or stiffeners 16 provides a positive bolted connection. The connection is not dependent upon any frictional or clamping action as frequently suggested in prior art proposals. Thus, extra strength and reliability of the form system is assured. Most important, by utilizing the connecting brackets 50, simplicity and ease of completing the concrete form panel support structure is achieved.

It should be obvious from the above discussed apparatus embodiments that numerous other variations and modifications of the apparatus of this invention will readily occur to those skilled in the art. Accordingly, the scope of this invention is not to be limited by the embodiments disclosed but is to include all such embodiments encompassed within the scope of the claims appended hereto.

I claim:

1. Apparatus for use in concrete form panel support comprising:

an elongate beam having a generally uniform I-shaped cross section with an outwardly opening pocket extending along one edge thereof to retain a nailer for securing said beam to a form panel and a Y-shaped segment extending along the opposite edge of said beam, said segment being formed by legs having one length thereof parallel to define therebetween an outwardly opening cavity and a second length of said legs diverging outwardly from said first length, said legs having oppositely directed flanges extending from the outer ends of the diverging second length of said legs;

a bracket having a flat portion insertable into said cavity and means functioning as a fastening tubular portion connected to said flat portion, said tubular portion accommodating a fastening element therewithin to fasten said bracket and the elongate beam carried thereby to a stiffener member of the form panel support structure;

means enabling said flat portion of said bracket to be secured in said cavity of the beam Y-shaped segment at a predetermined position along the length of said beam;

a fastening element received within said tubular portion of said bracket; and a stiffener member engaged by said fastening element formed by strong back elements that are each engaged by said fastening element with said strong back elements being spaced by the length of said tubular portion of said bracket therebetween.

2. Apparatus as recited in claim 1 wherein said strongback elements are elongated channels.

* * * * *